US011183792B2

(12) United States Patent
Chu et al.

(10) Patent No.: US 11,183,792 B2
(45) Date of Patent: Nov. 23, 2021

(54) DRIVE LOADING JIG FOR MEMORY DRIVES

(71) Applicant: SK hynix Inc., Gyeonggi-do (KR)

(72) Inventors: Chee Hoe Chu, San Jose, CA (US); Alexander Geoffrey Jensen, Los Altos Hills, CA (US)

(73) Assignee: SK hynix Inc., Gyeonggi-do (KR)

( * ) Notice: Subject to any disclaimer, the term of this patent is extended or adjusted under 35 U.S.C. 154(b) by 28 days.

(21) Appl. No.: 16/433,714

(22) Filed: Jun. 6, 2019

(65) Prior Publication Data

US 2019/0379157 A1 Dec. 12, 2019

Related U.S. Application Data

(60) Provisional application No. 62/681,437, filed on Jun. 6, 2018.

(51) Int. Cl.

| | |
|---|---|
| ***H01R 13/627*** | (2006.01) |
| ***H01R 12/71*** | (2011.01) |
| ***H01R 13/56*** | (2006.01) |
| ***H01R 12/73*** | (2011.01) |

(52) U.S. Cl.

CPC ..... *H01R 13/6271* (2013.01); *H01R 12/716* (2013.01); *H01R 12/735* (2013.01); *H01R 13/562* (2013.01)

(58) Field of Classification Search

CPC ..... H01R 13/562; H01R 13/6271; H01R 12/716–725; B65B 5/04

See application file for complete search history.

(56) References Cited

U.S. PATENT DOCUMENTS

| | | | | |
|---|---|---|---|---|
| 4,017,770 A * | 4/1977 | Valfre | H05K 7/1435 | 361/756 |
| 4,243,283 A * | 1/1981 | McSparran | H01R 12/89 | 439/157 |
| 5,427,534 A * | 6/1995 | Spickler | H01R 13/28 | 439/64 |
| 5,860,828 A * | 1/1999 | Anderson | H01R 12/7005 | 439/377 |
| 6,006,987 A * | 12/1999 | Hoolhorst | G06K 7/0021 | 235/375 |
| 6,033,253 A * | 3/2000 | Yi | H01R 13/24 | 439/377 |
| 7,232,315 B2 * | 6/2007 | Uchida | H01R 12/721 | 439/492 |

(Continued)

*Primary Examiner* — Edwin A. Leon
*Assistant Examiner* — Milagros Jeancharles
(74) *Attorney, Agent, or Firm* — IP & T Group LLP

(57) ABSTRACT

A drive loading jig, drive carrier assembly and method of using the same to insert and remove a drive from a host reduce the likelihood of a drive being damaged during insertion or removal. Such a drive loading jig has side walls with respective slots and a rear wall joining the side walls. Each of the slots includes multiple restraining walls to restrain a drive, when positioned in the jig, from bending with respect to a plane parallel to a major surface of the drive and from moving in a direction substantially perpendicular to the major surface. Stoppers formed in the side walls or rear wall define a maximum insertion depth of the drive. An alignment key-way on the loading jig is used to align the drive in the proper orientation prior to inserting the drive into the loading jig.

3 Claims, 10 Drawing Sheets

(56) References Cited

U.S. PATENT DOCUMENTS

| | | | | |
|---|---|---|---|---|
| 9,509,102 | B2 * | 11/2016 | Sharf | H05K 7/20436 |
| 10,104,760 | B1 * | 10/2018 | Briant | G02B 6/4284 |
| 10,114,179 | B2 * | 10/2018 | Kamada | G02B 6/3898 |
| 10,140,063 | B2 * | 11/2018 | Worley | G06F 3/0683 |
| 10,559,920 | B1 * | 2/2020 | Champion | H01R 12/73 |
| 2005/0094364 | A1 * | 5/2005 | Chang | G06F 1/182 361/679.31 |
| 2008/0227305 | A1 * | 9/2008 | Sabo | H01R 31/06 439/65 |
| 2010/0188828 | A1 * | 7/2010 | Takao | G06F 1/1613 361/759 |
| 2013/0059458 | A1 * | 3/2013 | Chang | H01R 12/7029 439/328 |
| 2013/0115814 | A1 * | 5/2013 | Briant | H01R 12/721 439/607.08 |
| 2013/0151745 | A1 * | 6/2013 | Yin | G06F 1/185 710/301 |
| 2014/0199866 | A1 * | 7/2014 | Tang | H01R 13/7175 439/159 |
| 2015/0355686 | A1 | 12/2015 | Heyd et al. | |
| 2015/0366086 | A1 * | 12/2015 | Kajiwara | H01R 12/721 361/736 |
| 2016/0134040 | A1 * | 5/2016 | Phillips | H01R 12/721 439/374 |
| 2016/0149323 | A1 * | 5/2016 | Figuerado | H01R 12/716 439/345 |
| 2016/0211626 | A1 * | 7/2016 | Long | G02B 6/4284 |
| 2016/0268713 | A1 * | 9/2016 | Norton | G06F 13/4068 |
| 2016/0294087 | A1 * | 10/2016 | Norton | H01R 12/721 |
| 2017/0133794 | A1 * | 5/2017 | Hinkle | H01R 13/6581 |
| 2018/0054010 | A1 * | 2/2018 | Xu | H01R 12/737 |
| 2019/0214754 | A1 * | 7/2019 | Annis | H01R 13/621 |

* cited by examiner

DRIVE LOADING JIG FOR MEMORY DRIVES

CROSS-REFERENCE TO RELATED APPLICATION

This application claims the benefit of U.S. Provisional Application No. 62/681,437, filed Jun. 6, 2018, the entire content of which is incorporated herein by reference.

BACKGROUND

1. Field

Embodiments of the present disclosure relate to a drive loading jig for inserting a drive into, and removing a drive from, a host device.

2. Description of the Related Art

The computer environment paradigm has shifted to ubiquitous computing systems that can be used anytime and anywhere. As a result, the use of portable electronic devices, such as mobile phones, digital cameras, and notebook computers has rapidly increased. These portable electronic devices generally use a memory system having memory device(s), that is, data storage device(s). The data storage device is used as a main memory device or an auxiliary memory device of the portable electronic devices.

Data storage devices used as memory devices provide excellent stability, durability, high information access speed, and low power consumption, since they have no moving parts. Examples of data storage devices having such advantages include universal serial bus (USB) memory devices, memory cards having various interfaces, and solid state drives (SSD).

The SSD may include flash memory components and a controller, which includes the electronics that bridge the flash memory components to the SSD input/output (I/O) interfaces. The SSD controller may include an embedded processor that executes functional components such as firmware. The SSD functional components are typically device specific, and in most cases, can be updated.

One type of SSD, known as an M.2 SSD, where M.2 is a form factor, is a relatively flat, rectangular shaped device. An M.2 SSD is adapted to be inserted into an M.2 slot in a computer, server or other compatible host. An M.2 drive does not include a protective case. Much like dynamic random access memory (DRAM) dual in-line memory modules (DIMMs), components mounted on an M.2 SSD are fully exposed, and as a result, can be easily knocked loose or damaged by external forces introduced during handling and installation. Moreover, the printed circuit board (PCB) of the M.2 drive can be damaged as a result of bending when the drive is inserted into, or removed from, the host without proper handling.

An M.2 drive needs to endure multiple insertion and removal cycles during various testing stages, i.e., manufacturing and integration testing. Additional handling is needed during final deployment. Ten insertion and removal cycles is not uncommon.

With this amount of handling, not only is damage to the drive a very real possibility, damage to event critical components may not even be detected until after occurrence of such critical event. The severity of the damage may extend to compromising important data stored in the drive.

Thus, a safer, more reliable way of loading drives, such as M.2 drives, into its host is needed. In this context embodiments of the present invention arise.

SUMMARY

An aspect of the present invention includes drive loading jigs. One such drive loading jig comprises a first wall having a first slot and a first stopper formed therein; a second side wall having a second slot and a second stopper formed therein; and a rear wall joining the first and second side walls. The first and second side walls define an opening at an opposite end of the drive loading jig with respect to the rear wall. Each of the first and second slots includes multiple restraining walls configured to restrain a drive, when positioned in the drive loading jig, from bending with respect to a plane parallel to a major surface of the drive and from moving in a direction substantially perpendicular to the major surface. The first and second stoppers are configured to define a maximum insertion depth of the drive.

Another aspect of the present invention includes a drive carrier assembly. One such assembly comprises a drive loading jig and an adapter card. The drive loading jig comprises a first wall having a first slot and a first stopper formed therein, a second side wall having a second slot and a second stopper formed therein, and a rear wall joining the first and second side walls. The adapter card comprises a major surface adapted to support the drive loading jig when loaded with a drive, and a connector disposed on the major surface and configured to connect with a connector interface on the drive.

Further aspects of the present invention include methods of using a drive loading jig to insert a drive into a host. One such method comprises aligning a key-way on the drive with a key-way on the drive loading jig; aligning an insertion end of the drive with an opening of the drive loading jig to orient longitudinal edges of the drive with slots formed along a length of a drive loading jig; inserting the drive into the drive loading jig to an insertion depth defined by stoppers in the drive loading jig, such that the longitudinal edges of the drive are secured in their respective slots, and such that a connector interface of the drive is exposed at the opening of the drive loading jig; positioning the drive loading jig with the drive inserted therein such that the length of the drive loading jig with respect to a mating surface of a connector on a host is at a specific angle within a set insertion angle range; and inserting the connector interface of the drive, while in the drive loading jig, into the connector on the host, maintaining the drive loading jig at the specific angle.

Additional aspects of the present invention will become apparent from the following description.

DETAILED DESCRIPTION

Figure 1:
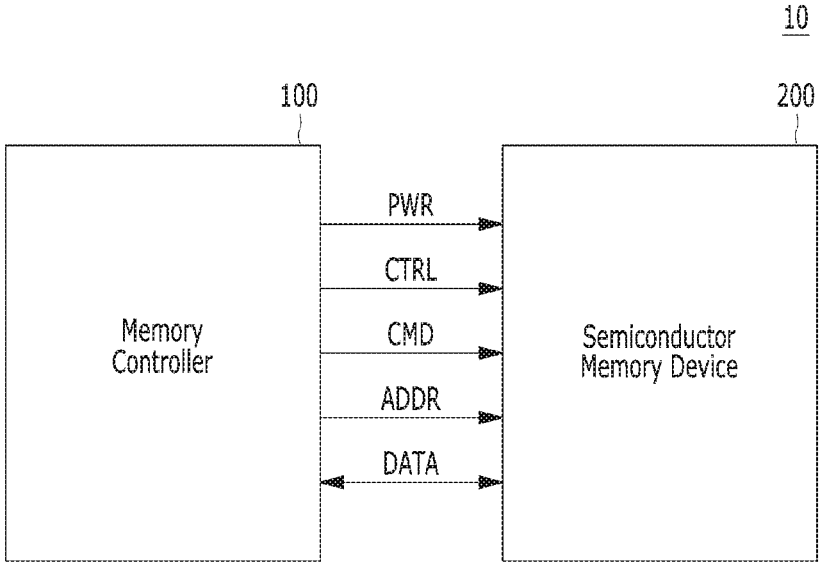
FIG. 1 is a block diagram illustrating a memory system in accordance with an embodiment of the present invention.

Various embodiments are described below in more detail with reference to the accompanying drawings. The present invention may, however, be embodied in different forms and thus should not be construed as limited to the embodiments set forth herein. Rather, these embodiments are provided so that this disclosure is thorough and complete and fully conveys the scope of the present invention to those skilled in the art. Moreover, reference herein to "an embodiment," "another embodiment," or the like is not necessarily to only one embodiment, and different references to any such phrase are not necessarily to the same embodiment(s). Throughout the disclosure, like reference numerals refer to like parts in the figures and embodiments of the present invention.

The invention can be implemented in numerous ways, including as a device, a process and a system. In this specification, operations or processing steps may be referred to as techniques. In general, the order of the steps of disclosed processes may be altered within the scope of the invention. Unless stated otherwise, a component such as a processor or a memory described as being suitable for performing a task may be implemented as a general component that is temporarily configured to perform the task at a given time or a specific component that is manufactured to perform the task. As used herein, the term 'processor' or the like refers to one or more devices, circuits, and/or processing cores suitable for processing data, such as computer program instructions.

A detailed description of embodiments of the invention is provided below along with accompanying figures that illustrate aspects of the invention. The invention is described in connection with such embodiments, but the invention is not limited to any embodiment. The scope of the invention is limited only by the claims. The invention encompasses numerous alternatives, modifications and equivalents within the scope of the claims. Numerous specific details are set forth in the following description in order to provide a thorough understanding of the invention. These details are provided for the purpose of example; the invention may be practiced according to the claims without some or all of these specific details. For clarity, technical material that is known in technical fields related to the invention has not been described in detail so that the invention is not unnecessarily obscured.

FIG. 1 is a block diagram schematically illustrating a memory system in accordance with an embodiment of the present invention.

Referring to FIG. 1, the memory system 10 may include a memory controller 100 and a semiconductor memory device 200, which may represent more than one such device. The semiconductor memory device(s) 200 may be flash memory device(s), particularly of the NAND-type. For brevity, semiconductor memory device 200 is sometimes simply referred to as memory device 200.

The memory controller 100 may control overall operations of the semiconductor memory device 200.

The semiconductor memory device 200 may perform one or more erase, program, and read operations under the control of the memory controller 100. The semiconductor memory device 200 may receive a command CMD, an address ADDR and data DATA through input/output (I/O) lines. The semiconductor memory device 200 may receive power PWR through a power line and a control signal CTRL through a control line. The control signal CTRL may include a command latch enable (CLE) signal, an address latch enable (ALE) signal, a chip enable (CE) signal, a write enable (WE) signal, a read enable (RE) signal, and the like.

The memory controller 100 and the semiconductor memory device 200 may be integrated in a single semiconductor device such as a solid state drive (SSD). The SSD may include a storage device for storing data therein. When the semiconductor memory system 10 is used in an SSD, operation speed of a host (not shown) coupled to the memory system 10 may remarkably improve.

The memory controller 100 and the semiconductor memory device 200 may be integrated in a single semiconductor device such as a memory card. For example, the memory controller 100 and the semiconductor memory device 200 may be so integrated to configure a PC card of personal computer memory card international association (PCMCIA), a compact flash (CF) card, a smart media (SM) card, a memory stick, a multimedia card (MMC), a reduced-size multimedia card (RS-MMC), a micro-size version of MMC (MMCmicro), a secure digital (SD) card, a mini secure digital (miniSD) card, a micro secure digital (microSD) card, a secure digital high capacity (SDHC) card, and/or a universal flash storage (UFS).

In another embodiment, the memory system 10 may be provided as one of various components in an electronic device, such as a computer, an ultra-mobile PC (UMPC), a workstation, a net-book computer, a personal digital assistant (PDA), a portable computer, a web tablet PC, a wireless phone, a mobile phone, a smart phone, an e-book reader, a portable multimedia player (PMP), a portable game device, a navigation device, a black box, a digital camera, a digital multimedia broadcasting (DMB) player, a 3-dimensional television, a smart television, a digital audio recorder, a digital audio player, a digital picture recorder, a digital picture player, a digital video recorder, a digital video player, a storage device of a data center, a device capable of receiving and transmitting information in a wireless environment, a radio-frequency identification (RFID) device, as well as one of various electronic devices of a home network, one of various electronic devices of a computer network, one of electronic devices of a telematics network, or one of various components of a computing system.

Figure 2:
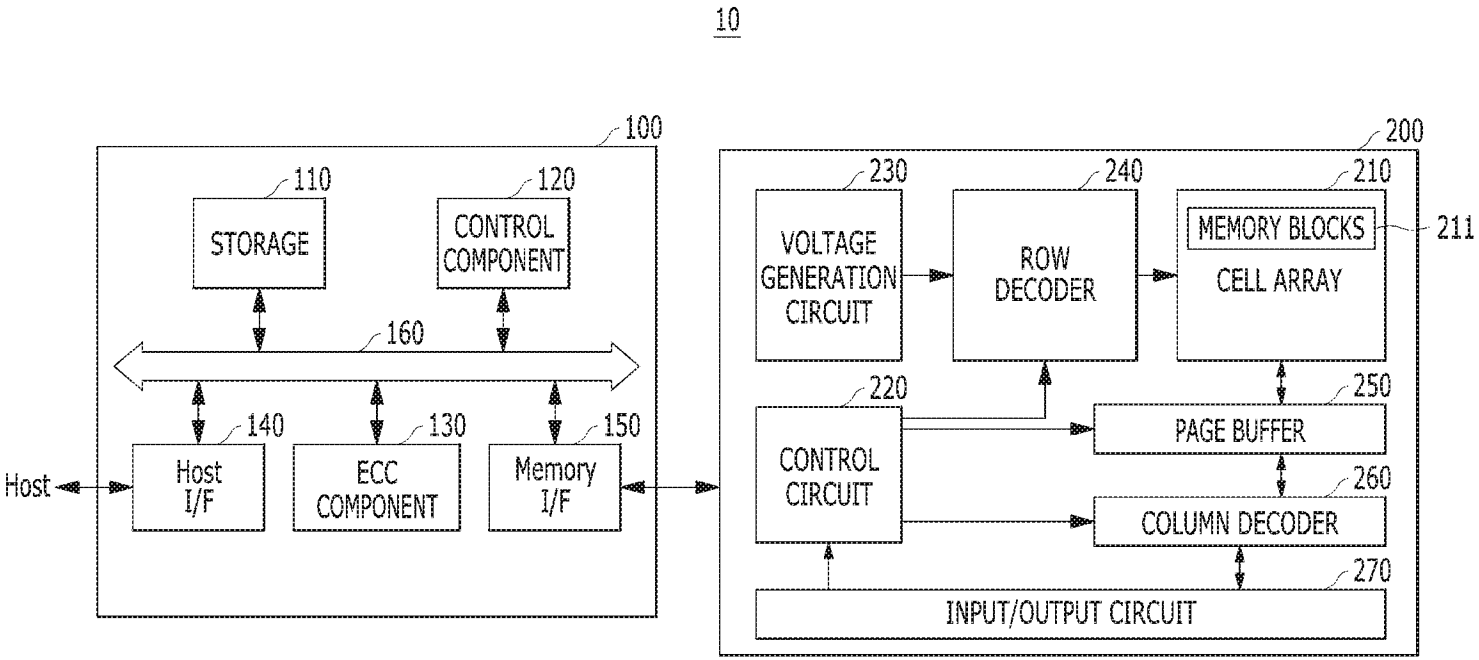
FIG. 2 is a block diagram illustrating a memory system in accordance with an embodiment of the present invention.

FIG. 2 is a detailed block diagram illustrating a memory system in accordance with an embodiment of the present invention. For example, the memory system of FIG. 2 may depict the memory system 10 shown in FIG. 1.

Referring to FIG. 2, the memory system 10 may include a memory controller 100 and a semiconductor memory device 200. The memory system 10 may operate in response to a request from a host device, and in particular, store data to be accessed by the host device.

The host device may be implemented with any one of various kinds of electronic devices. In some embodiments, the host device may include an electronic device, such as a desktop computer, a workstation, a three-dimensional (3D) television, a smart television, a digital audio recorder, a digital audio player, a digital picture recorder, a digital picture player, and/or a digital video recorder and a digital video player. In some embodiments, the host device may include a portable electronic device, such as a mobile phone, a smart phone, an e-book, an MP3 player, a portable multimedia player (PMP), and/or a portable game player.

The memory device 200 may store data to be accessed by the host device.

The memory device 200 may be implemented with a volatile memory device, such as a dynamic random access memory (DRAM) and/or a static random access memory (SRAM) or a non-volatile memory device, such as a read only memory (ROM), a mask ROM (MROM), a programmable ROM (PROM), an erasable programmable ROM (EPROM), an electrically erasable programmable ROM (EEPROM), a ferroelectric random access memory (FRAM), a phase change RAM (PRAM), a magnetoresistive RAM (MRAM), and/or a resistive RAM (RRAM).

The controller 100 may control storage of data in the memory device 200. For example, the controller 100 may control the memory device 200 in response to a request from the host device. The controller 100 may provide data read from the memory device 200 to the host device, and may store data provided from the host device into the memory device 200.

The controller 100 may include a storage 110, a control component 120, which may be implemented as a processor, e.g., a central processing unit (CPU), an error correction code (ECC) component 130, a host interface (I/F) 140 and a memory interface (I/F) 150, which are coupled through a bus 160.

The storage 110 may serve as a working memory of the memory system 10 and the controller 100, and store data for driving the memory system 10 and the controller 100. When the controller 100 controls operations of the memory device 200, the storage 110 may store data used by the controller 100 and the memory device 200 for such operations as read, write, program and erase operations.

The storage 110 may be implemented with a volatile memory such as a static random access memory (SRAM) or a dynamic random access memory (DRAM). As described above, the storage 110 may store data used by the host device in the memory device 200 for the read and write operations. To store the data, the storage 110 may include a program memory, a data memory, a write buffer, a read buffer, a map buffer, and the like.

The control component 120 may control general operations of the memory system 10, and a write operation or a read operation for the memory device 200, in response to a write request or a read request from the host device. The control component 120 may drive firmware, which is referred to as a flash translation layer (FTL), to control general operations of the memory system 10. For example, the FTL may perform operations, such as logical-to-physical (L2P) mapping, wear leveling, garbage collection, and/or bad block handling. The L2P mapping is known as logical block addressing (LBA).

The ECC component 130 may detect and correct errors in the data read from the memory device 200 during the read operation. The ECC component 130 may not correct error bits when the number of the error bits is greater than or equal to a threshold number of correctable error bits, and instead may output an error correction fail signal indicating failure in correcting the error bits.

The ECC component 130 may perform an error correction operation based on a coded modulation, such as a low-density parity-check (LDPC) code, a Bose-Chaudhuri-Hocquenghem (BCH) code, a turbo code, a turbo product code (TPC), a Reed-Solomon (RS) code, a convolution code, a recursive systematic code (RSC), a trellis-coded modulation (TCM), and a block coded modulation (BCM).

The host interface 140 may communicate with the host device through one or more of various interface protocols, such as a universal serial bus (USB), a multi-media card (MMC), a peripheral component interconnect express (PCI-e or PCIe), a small computer system interface (SCSI), a serial-attached SCSI (SAS), a serial advanced technology attachment (SATA), a parallel advanced technology attachment (PATA), an enhanced small disk interface (ESDI), and an integrated drive electronics (IDE).

The memory interface 150 may provide an interface between the controller 100 and the memory device 200 to allow the controller 100 to control the memory device 200 in response to a request from the host device. The memory interface 150 may generate control signals for the memory device 200 and process data under the control of the control component or CPU 120. When the memory device 200 is a flash memory such as a NAND flash memory, the memory interface 150 may generate control signals for the memory and process data under the control of the CPU 120.

The memory device 200 may include a memory cell array 210, a control circuit 220, a voltage generation circuit 230, a row decoder 240, a page buffer 250, which may be in the form of an array of page buffers, a column decoder 260, and an input/output circuit 270. The memory cell array 210 may include a plurality of memory blocks 211 which may store data. The voltage generation circuit 230, the row decoder 240, the page buffer (array) 250, the column decoder 260 and the input/output circuit 270 may form a peripheral circuit for the memory cell array 210. The peripheral circuit may perform a program, read, or erase operation of the memory cell array 210. The control circuit 220 may control the peripheral circuit.

The voltage generation circuit 230 may generate operation voltages of various levels. For example, in an erase operation, the voltage generation circuit 230 may generate operation voltages of various levels such as an erase voltage and a pass voltage.

The row decoder 240 may be in electrical communication with the voltage generation circuit 230, and the plurality of memory blocks 211. The row decoder 240 may select at least one memory block among the plurality of memory blocks 211 in response to a row address RADD generated by the control circuit 220, and transmit operation voltages supplied from the voltage generation circuit 230 to the selected memory blocks.

Figure 3:
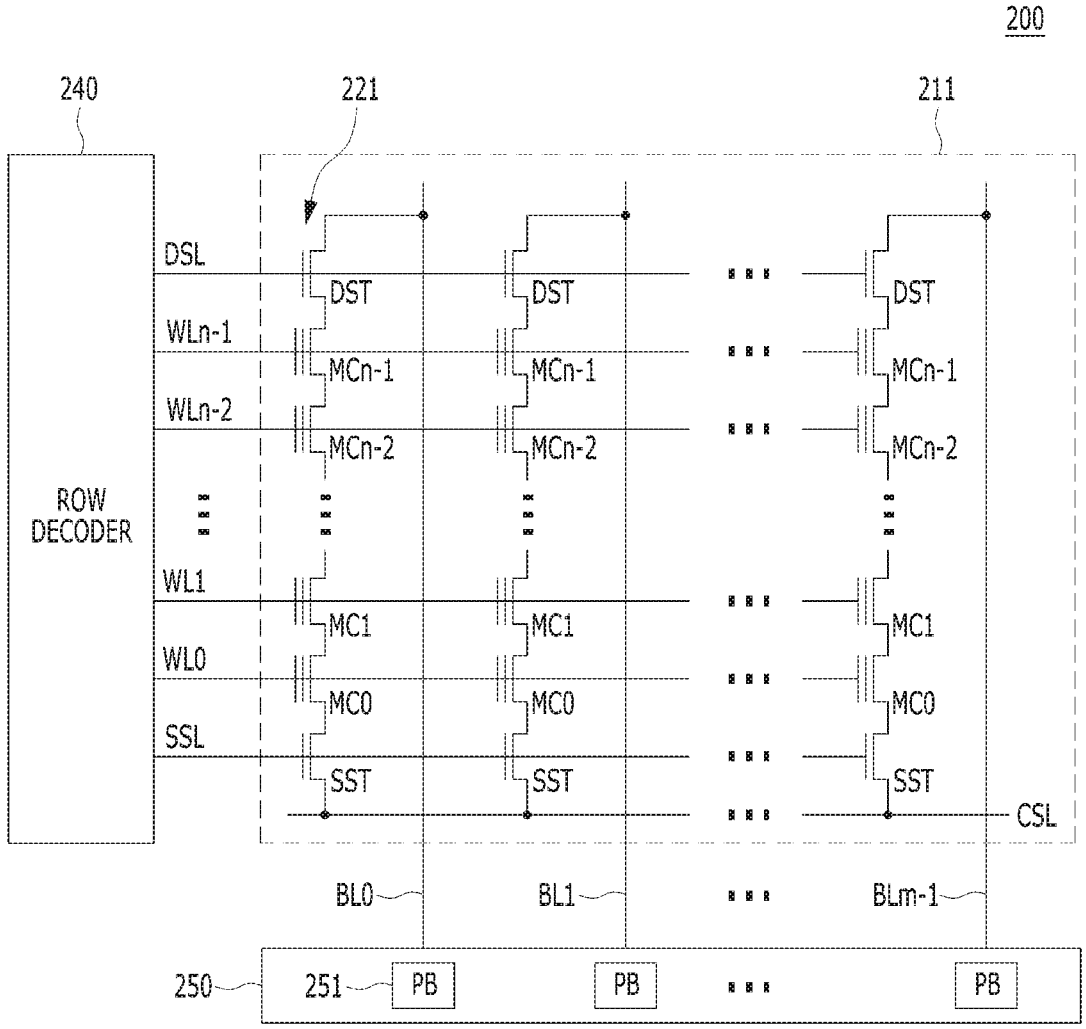
FIG. 3 is a circuit diagram illustrating a memory block of a memory device of a memory system in accordance with an embodiment of the present invention.

The page buffer (array) 250 may be in electrical communication with the memory cell array 210 through bit lines BL (shown in FIG. 3). The page buffer (array) 250 may precharge the bit lines BL with a positive voltage, transmit data to, and receive data from, a selected memory block in program and read operations, or temporarily store transmitted data, in response to page buffer control signal(s) generated by the control circuit 220.

The column decoder 260 may transmit data to, and receive data from, the page buffer (array) 250, and may also exchange data with the input/output circuit 270.

The input/output circuit 270 may transmit to the control circuit 220 a command and an address, received from an external device (e.g., the memory controller 100), transmit data from the external device to the column decoder 260, or output data from the column decoder 260 to the external device, through the input/output circuit 270.

The control circuit 220 may control the peripheral circuit in response to the command and the address.

FIG. 3 is a circuit diagram illustrating a memory block of a semiconductor memory device in accordance with an embodiment of the present invention. For example, the memory block of FIG. 3 may be any of the memory blocks 211 of the memory cell array 210 shown in FIG. 2.

Referring to FIG. 3, the exemplary memory block 211 may include a plurality of word lines WL0 to WLn−1, a drain select line DSL and a source select line SSL coupled to the row decoder 240. These lines may be arranged in parallel with the plurality of word lines between the DSL and SSL.

The exemplary memory block 211 may further include a plurality of cell strings 221 respectively coupled to bit lines BL0 to BLm−1. The cell string of each column may include one or more drain selection transistors DST and one or more source selection transistors SST. In the illustrated embodiment, each cell string has one DST and one SST. In a cell string, a plurality of memory cells or memory cell transistors MC0 to MCn−1 may be serially coupled between the selection transistors DST and SST. Each of the memory cells may be formed as a multi-level cell (MLC) storing data information of multiple bits.

The source of the SST in each cell string may be coupled to a common source line CSL, and the drain of each DST may be coupled to the corresponding bit line. Gates of the SSTs in the cell strings may be coupled to the SSL, and gates of the DSTs in the cell strings may be coupled to the DSL. Gates of the memory cells across the cell strings may be coupled to respective word lines. That is, the gates of memory cells MC0 are coupled to corresponding word line WL0, the gates of memory cells MC1 are coupled to corresponding word line WL1, etc. The group of memory cells coupled to a particular word line may be referred to as a physical page. Therefore, the number of physical pages in the memory block 211 may correspond to the number of word lines.

As previously noted, the page buffer 250 may be in the form of a page buffer array including a plurality of page buffers 251 that are coupled to the bit lines BL0 to BLm−1. The page buffers 251 may operate in response to page buffer control signals. For example, the page buffers 251 may temporarily store data received through the bit lines BL0 to BLm−1 or sense voltages or currents of the bit lines during a read or verify operation.

In some embodiments, the memory blocks 211 may include a NAND-type flash memory cell. However, the memory blocks 211 are not limited to such cell type, but may include NOR-type flash memory cell(s). Memory cell array 210 may be implemented as a hybrid flash memory in which two or more types of memory cells are combined, or one-NAND flash memory in which a controller is embedded inside a memory chip.

Many memory systems 100 are in the configuration of an SSD, e.g., an M.2 SSD, in the form of a non-rigid, thin, rectangular element, similar in shape to a stick of gum. M.2 SSD's are 22 mm wide and come in various lengths depending on their specific form factor designation. A surface of the SSD contains a PCB and other components. Such SSDs are somewhat fragile, and as a consequence, are prone to damage, even from slight mishandling. Embodiments of the present invention are directed to tools and methods for improving handling of such SSDs.

In accordance with embodiments of the present invention, a drive loading jig and methods of using the same are provided. Use of the jig to insert a drive into, and remove it from, a host advantageously greatly decreases the likelihood that the PCB or components of the drive will be damaged as a result of mishandling. From the user's standpoint, the drive loading jig takes at least some of the guesswork out of the installation and removal processes. The design and rigidity of the loading jig prevents inadvertent bending of the PCB of the drive that may otherwise easily occur during installation or removal.

Figure 4:
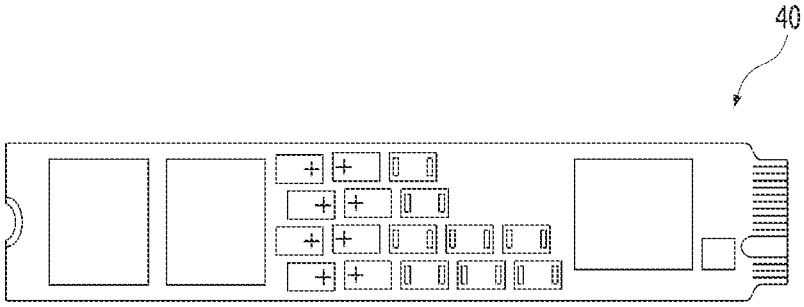
FIG. 4 is a plan view illustrating an exemplary M.2 drive.

FIG. 4 shows a typical M.2 drive 40 from a plan perspective. Embodiments are described in the context of an M.2 drive, to which the present invention has particular applicability. However, the present invention is not limited to that type of drive. Various dimensions and constructions may be altered to accommodate other drives having the same general shape, i.e., relatively flat and rectangular. Thus, M.2 drive 40 is sometimes referred to simply as drive 40.

As can be seen, the M.2 drive 40 is a relatively flat, rectangular piece. The M.2 drive 40 includes a PCB and various functional components, such as those described in connection with FIGS. 1-3.

Figure 5:
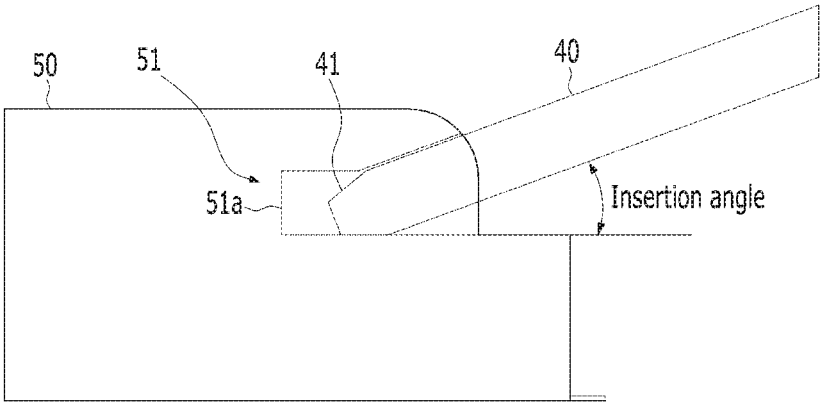
FIG. 5 is a side view illustrating insertion of an M.2 drive into a host, in accordance with an embodiment of the present invention.

Referring to FIG. 5, the M.2 drive 40 may be inserted into a host 50, e.g., a server, computer or other host, at an angle. According to a specification of the M.2 drive 40, the minimum insertion angle is 5°. In an embodiment, the preferred insertion angle is 20°. In another embodiment, the insertion angle is 25°+/−5°. More generally, the insertion angle or insertion angle range is determined to minimize the insertion and extraction force required to insert and remove the drive 40 from a connector 51 on the host 50. A connector interface 41 of the M.2 drive 40 is inserted into the connector 51 having a mating surface 51*a*. The connector interface 41 may be a PCIe connector interface, and the connector 51 may have a complementary configuration.

If the drive 40 is not inserted at a proper insertion angle, it may not sit in the host connector 51 properly. This may prompt the user or operator to apply force to the drive 40 in an effort to better position the drive 40 into the host connector 51, which may, in turn, damage the PCB of the drive 40 and/or components thereof. Such mishandling is even more likely to lead to a problem when the operator needs to insert or remove hundreds of drives as part of a batch testing or assembly process.

Figure 6:
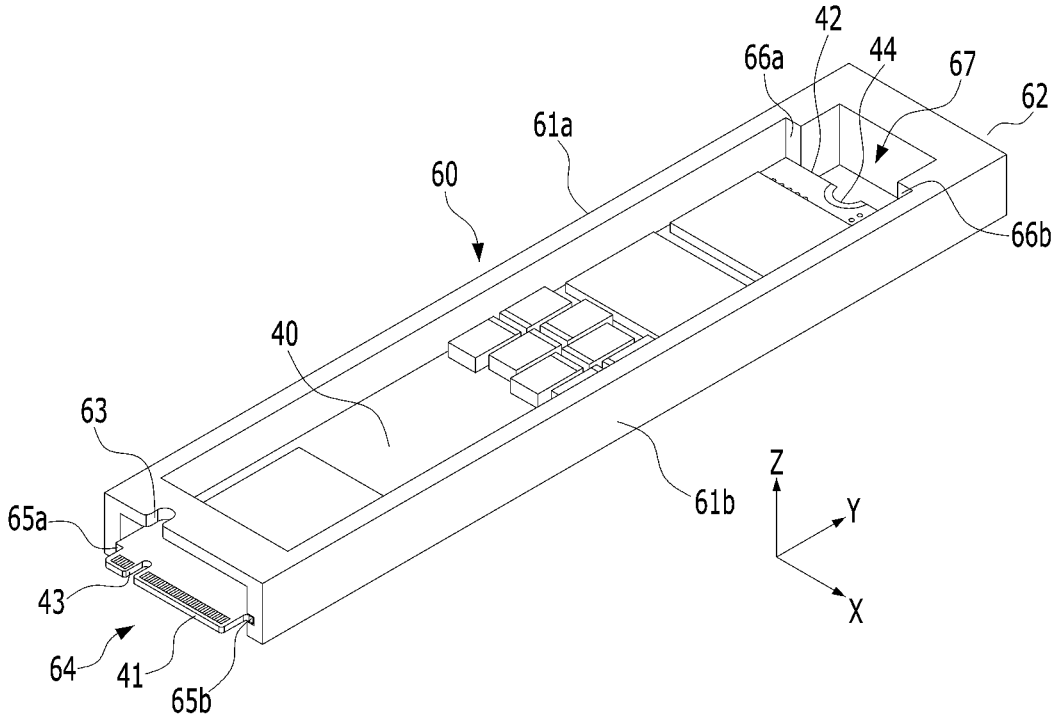
FIG. 6 is an isometric view of a drive loading jig with an M.2 drive mounted therein, in accordance with an embodiment of the present invention.

Thus, according to embodiments of the present invention, a drive loading jig 60, as shown in FIG. 6, is provided. For ease of description, the drive loading jig is sometimes referred to herein as a loading jig, loading sleeve, or even more simply, a jig or sleeve. A purpose of the drive loading jig 60 is to facilitate installation of the M.2 drive 40 to reduce the risk of damage to the drive 40 caused by mishandling or improper installation. The drive loading jig 60 allows the operator to align the drive 40 and its connector interface 41 with the connector 51 and its mating surface 51*a* of the host 50 at a proper angle and position. The drive loading jig 60 advantageously restricts deflection and bending of the PCB of the drive 40 in the positive (+) and negative (−) Z directions indicated in FIG. 6, i.e., in directions perpendicular to the surface of the drive 40, to reduce the risk of the PCB of the drive 40 bending during the assembly/installation process, which can lead to failure of the drive 40. The drive loading jig 60 is scalable in that it can be designed to accommodate installation of multiple M.2 drives 40 in the same process.

Figure 7:
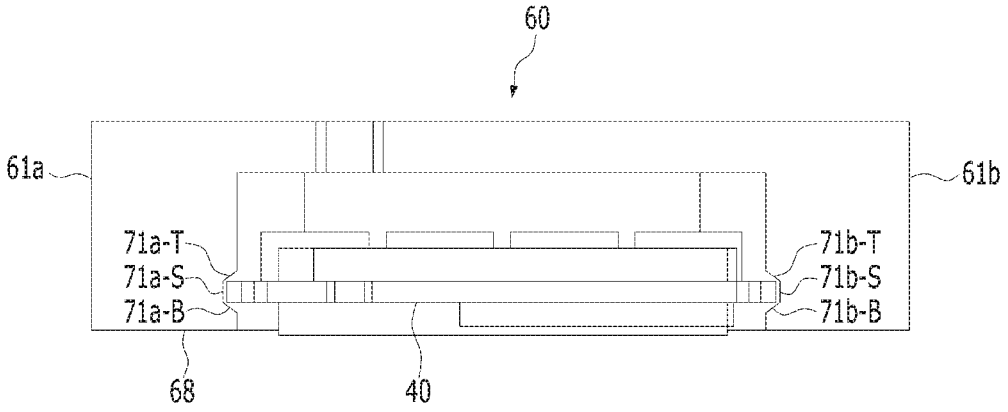
FIG. 7 is a front view of a drive loading jig, showing the insertion end thereof, in accordance with an embodiment of the present invention.

As shown in FIG. 6, the drive loading jig 60 has two elongated side walls 61*a*, 61*b* extending along respective sides of the jig 60 and connected by a rear wall 62, a front wall with an alignment key-way 63 formed therein and a bottom surface 68, the latter of which is shown in FIG. 7. The side walls 61*a*, 61*b* define an open end 64 at the opposite end of the rear wall 62. Slots 65*a*, 65*b* are formed in the interiors of the side walls 61*a*, 61*b*, respectively. The slots 65*a*, 65*b* are dimensioned and formed to engage respective length-wise edges of the drive 40 when PCB bending occurs. The slots 65*a*, 65*b* are dimensioned such that the drive 40 slides with little or no resistance into and out of the loading jig 60 while preventing the drive 40 from excessively bending during installation and removal. Moreover, the slots 65*a*, 65*b* extend along the length of the of the drive loading jig 60 in the Y direction to stoppers 66*a*, 66*b*, respectively, which an insertion end 42 of the drive 40 contacts when fully inserted into the drive loading jig 60. Stoppers 66*a*, 66*b* are formed as part of the rear wall 62 and/or respective side walls 61*a*, 61*b*.

When the drive 40 is fully inserted into the drive loading jig 60, as shown in FIG. 6, the interior of the rear wall 62, the stoppers 66*a*, 66*b*, and the insertion end 42 define a retainer access area 67. The insertion end 42 of the drive 40 includes a mounting cutout 44, the function of which is explained below.

As shown in FIG. 6, when fully inserted into the drive loading jig 60, the connector interface 41 of the drive 40 extends beyond the open end 64 and the slots 65*a*, 65*b* of the drive loading jig 60. An interface key-way 43 formed in the connector interface 41 is also exposed. This enables the connector interface 41 and interface key-way 43 to properly connect with the connector 51 of the host 50. It also allows the operator to visually align the connector interface 41 with the connector 51 of the host 50. The interface keyway 43 aligns with the loading jig alignment key-way 63.

Referring to FIG. 7, which is a front view looking into the open end 64 of the drive loading jig 60, the slots 65*a*, 65*b* are shown with more precision. Taken in conjunction with FIG. 6, FIG. 7 shows that the slot 65*a* has multiple restraint walls including a top restraint wall 71*a*-T, a side restraint wall 71*a*-S and a bottom restraint wall 71*a*-B. Likewise, slot 65*b* has multiple restraint walls including a top restraint wall 71*b*-T, side restraint wall 71*b*-S and bottom restraint wall 71*b*-B. The restraint walls are designed and formed to support the length-wise edges of the drive 40 and restrict bending of its PCB in the +/−Z direction shown in FIG. 6. The top and bottom restraint walls 71*a*-T, 71*b*-T, 71*a*-B and 71*b*-B may be angled as shown in FIG. 7. The angular orientation, particularly of the top restraint walls 71*a*-T, 71*b*-T, may be set to accommodate edge components, which may be present on some drives 40.

The restraint walls, particularly the top and bottom restraint walls 71*a*-T, 71*b*-T, 71*a*-B and 71*b*-B, cooperate to support the longitudinal edges of the drive 40, e.g., M.2 drive, on both its top and bottom surfaces when the drive 40 is inserted into the jig 60. Such support reduces the risk of excess bending of the PCB in the positive (+) and negative (−) Z directions shown in FIG. 6, i.e., perpendicular to the surface of the drive 40. The side restraint walls 71*a*-S and 71*b*-S act to restrain the drive in the positive (+) and negative (−) X directions shown in FIG. 6, e.g., side-to-side.

Overall, the slots 65*a*, 65*b* including their respective sets of walls (71*a*-T, 71*a*-S, 71*a*-B) and 71*b*-T, 71*b*-S, 71*b*-B) are dimensioned to accommodate components on the drive 40, to ensure that the drive 40 slides with little or no resistance into and out of the loading jig 60, and to prevent the drive 40 from excessively bending, i.e., to the point of being damaged or inoperable, during installation and removal.

Figure 8:
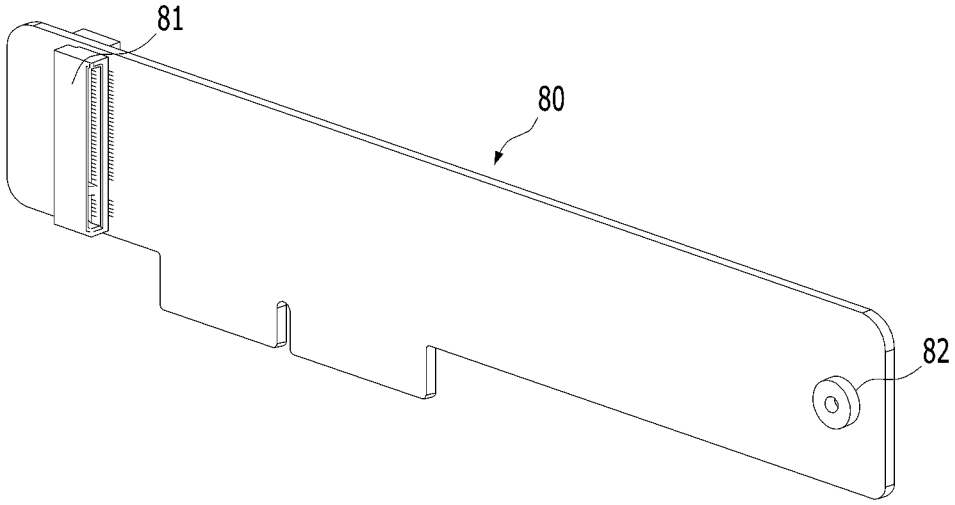
FIG. 8 is a perspective view of an M.2 drive adapter card and associated components, in accordance with an embodiment of the present invention.

Instances which can cause bending of the PCB of the M.2 drive 40, leading to drive failures, can occur during installation of the M.2 drive 40 into an M.2 drive adapter card 80, which is shown in FIG. 8. The drive adapter card 80 includes an M.2 connector 81 and a locking or fastening feature 82. The fastening feature 82 may be any means of securing the M.2 drive 40 to the drive adapter card 80. For example, a nut and screw, press-fit locking feature, spring-finger, or similar element may be used.

During the installation process, it is possible for the operator to attempt to over-insert the drive 40 into the M.2 connector 81 on the drive adapter card 80, which can cause bending of the PCB of the drive 40, thus causing drive failure. Moreover, if there is misalignment in the initial insertion of the connector interface 41 of the drive 40 into the connector 81, the act of moving or swinging the drive 40 down to engage it with the fastening feature 82 of the adapter card 80 may also cause bending of the PCB of the drive 40, which in turn may cause drive failure. Other types of mishandling of the drive 40 during installation may also occur. For example, using a finger to push down on the mid-span of the PCB of the drive 40 while guiding it to the adapter card 80, can cause PCB bending leading to drive failure.

To use the loading jig 60, first the key-way 43 on the drive 40 is aligned with the loading jig key-way 63 on the jig 60 so that the two key-ways are at the same position on the X-axis in FIG. 6. Then, the insertion end 42 of the drive 40 is aligned with the open end of the jig 60 to orient the longitudinal edges of the drive with the slots 65*a* and 65*b*. Then, the drive 40 is slid into place within the jig 60 so as to be secured by the restraint walls 71*a* and 71*b*, with the connector interface 41 positioned at the open end 64 of the jig 60 and the insertion end 42 is in contact with the stoppers 66*a*, 66*b*.

With the drive 40 so placed in the jig 60, the operator may then fix the drive/jig assembly to the adapter card 80. Initially, the operator may align the jig 60 at least at a 5° inclined angle to the adapter card 80. Additionally, the operator may align the connector interface 41 so that its key-way 43 aligns with a key 81*a* of the connector 81 on the adapter card 80. Once the jig 60 is so aligned, it is ready to be inserted into the adapter card 80. The operator may insert the drive 40 until its connector interface 41 reaches the proper insertion depth in the connector 81 on the adapter card 80. Then, the loading jig 60 can be swung down into place, positioning the drive 40 in its final installed position in which the mounting cutout 44 of the drive 40 is gripped with the locking or fastening feature 82 of the adapter card 80. The retainer access area 67 of the loading jig 60 may be utilized to allow the jig 60 to be used with different types of locking or fastening features 82, such as screw, snap, slide lock, or spring-finger locking or fastening features.

The jig 60 is designed to be modular, in that it is capable of being scaled to accommodate installation of multiple drives 40 with a single procedure. Additionally, the jig 60 is capable of installing drives 40 to both sides of the adapter card 80 when configured with connectors 81 on both surfaces, as can be seen in FIG. 8.

Figure 9:
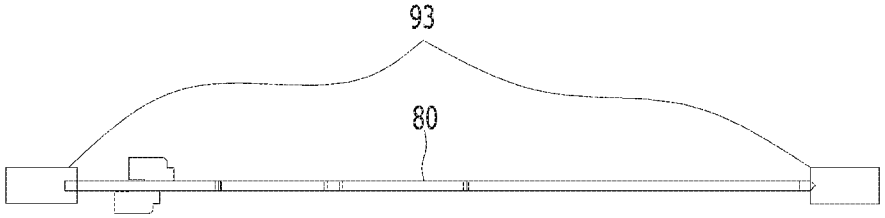
FIG. 9 is a side view of an M.2 drive adapter card, in accordance with an embodiment of the present invention.

For the purpose of securing the adapter card 80 during the installation process, an adapter card fixture 93 may be employed, as shown in FIG. 9. The fixture 93 supports the adapter card 80 on two opposing ends while still allowing access to the top and bottom connectors 81 for installation of two drives 40. FIG. 9 shows an example of how the adapter card 80 may be fixed in the fixture 93 during the drive installation process. However, in various embodiments, the drive loading jig 60 is used without the fixture 93.

Figure 10:
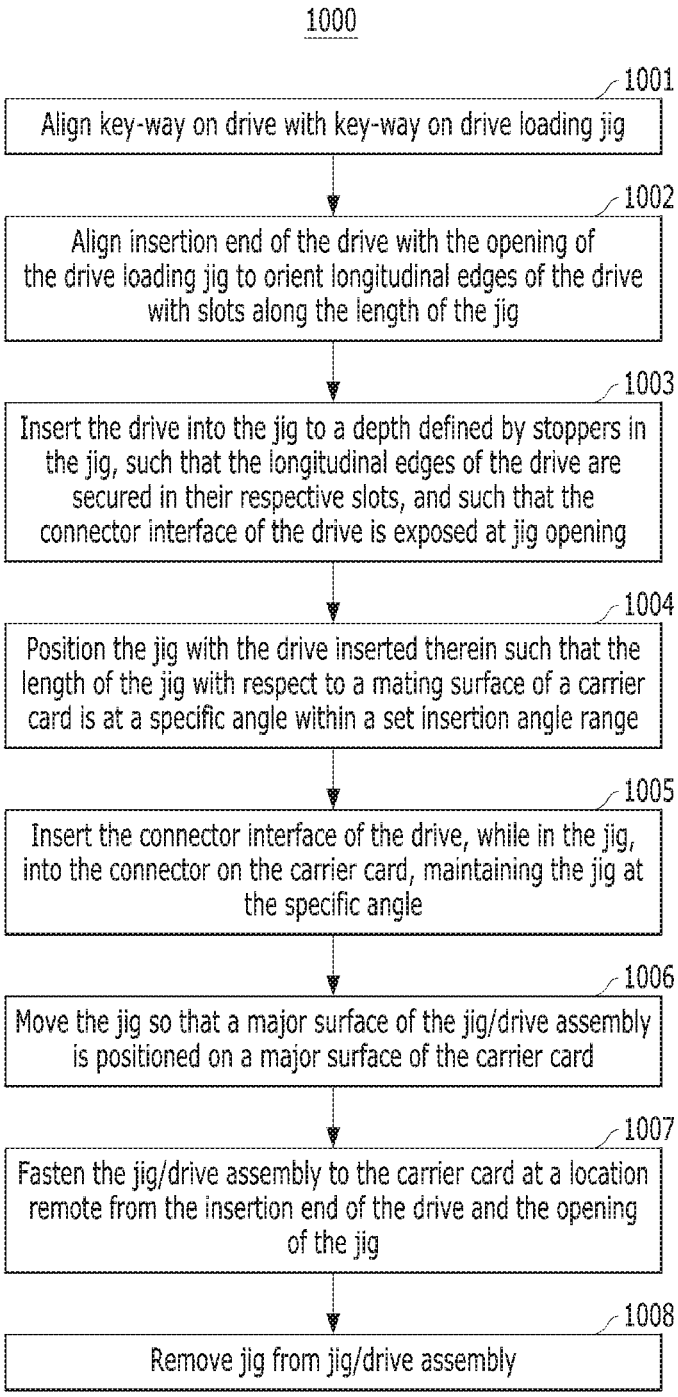
FIG. 10 is a flow chart illustrating steps in processes for loading an M.2 drive into a host using a drive loading jig, in accordance with embodiments of the present invention.

FIG. 10 is a flow chart describing steps in processes for inserting a drive into a host using a loading jig, in accordance with embodiments of the present invention. The steps shown in flow chart 1000 are exemplary. Those skilled in the art will understand that additional and/or alternative steps may be performed, or that the order of steps may be changed, to effectuate aspects of the present invention without departing from the inventive concepts disclosed herein. FIG. 10 is described with reference to FIGS. 4-9.

Initially, at step 1001, the key-way 43 on the drive 40 is aligned with the key-way 63 on the drive loading jig 60. When the drive 40 is inserted into the jig 60, both the alignment key-way 63 on the loading jig 60 and the key-way 43 on the drive 40 are at the same position along the X-axis shown in FIG. 6.

At step 1002, the insertion end 42 of the drive 40 is aligned with the open end 64 of the drive loading jig 60 to orient the longitudinal edges of the drive 40 with the slots 65*a*, 65*b* along the length of the jig 60. When so aligned, at step 1003, the drive 40 is inserted into the jig 60 to a depth defined by the stoppers 66*a*, 66*b* in the jig 60, such that the longitudinal edges of the drive 40 are secured in their respective slots 65*a*, 65*b*, and such that the connector interface 41 of the drive 40 is exposed at the open end 64 of the jig 60.

As noted above, the driving loading jig 60 with the drive 40 loaded therein may be used with the drive adapter card 80. In this embodiment, the loading jig/drive assembly is mounted on the adapter card 80.

Thus, in step 1004, the jig/drive assembly is positioned such that the length of the jig 60 (or jig/drive assembly) with respect to a mating surface of the adapter card 80 is within a set insertion angle range, which is at least 5° to the surface. Here, the mating surface of the adapter card 80 may be a major or principle surface thereof, i.e., the surface on which the connector 81 and the locking or fastening feature 82 are mounted. The insertion angle range is at least 5°. In an embodiment, the preferred insertion angle is 20°. In another embodiment, the preferred is 25°+/−5°.

Next, in step 1005, while maintaining the proper angular orientation of the jig/drive assembly with the mating surface of the adapter card 80, the connector interface 41 of the drive 40 is inserted into the connector 81 on the adapter card 80. Then, with the connector interface 41 inserted into the connector 81, in step 1006, the jig/drive assembly is moved or swung downwardly until it is in a parallel position on a major surface of the adapter card 80. In step 1007, the jig/drive assembly is fastened to the adapter card 80 using the fastener feature 82, which is located remotely from the connector 81 to support the other end of the jig/drive assembly.

At step 1008, the loading jig 60 may be removed from the jig/drive assembly. The loading jig 60 may be slid away from the connector end of the drive 40 along the Y-axis shown in FIG. 6.

As the foregoing demonstrates, embodiments of the present invention provide tools and techniques for inserting a drive into, and removing it from, a host, which greatly decreases the likelihood that the PCB or components of the drive will be damaged as a result of mishandling. The drive loading jig disclosed herein is easy to use. Moreover, the rigidity of the jig prevents inadvertent bending of the PCB of the drive that may otherwise easily occur during installation or removal.

Although the foregoing embodiments have been described in some detail for purposes of clarity and understanding, the present invention is not limited to the details provided. There are many alternative ways of implementing the invention, as one skilled in the art will appreciate in light of the foregoing disclosure. The disclosed embodiments are thus illustrative, not restrictive.

What is claimed is:

1. A method of using a drive loading jig, the method comprising:

aligning a key-way on a drive with a key-way on the drive loading jig;

aligning an insertion end of the drive with an opening of the drive loading jig to orient longitudinal edges of the drive with slots formed along a length of the drive loading jig;

inserting the drive into the drive loading jig to an insertion depth defined by stoppers in the drive loading jig, such that the longitudinal edges of the drive are secured in their respective slots, and such that a connector interface of the drive is exposed at the opening of the drive loading jig;

positioning the drive loading jig with the drive inserted therein with respect to a connector on a host such that the length of the drive loading jig is at an incline with respect to an insertion direction, wherein the incline is defined by a specific angle within a set insertion angle range; and inserting the connector interface of the drive, while in the drive loading jig, into the connector on the host, maintaining the drive loading jig at the specific angle, wherein the host is an adapter card, wherein the inserting of the connector interface of the drive comprises:

aligning the connector interface of the drive so that a key on the connector interface aligns with a key-way of the connector on the adapter card; and inserting the drive until the connector interface of the drive reaches a set insertion depth in the connector on the adapter card, wherein the method further comprises:

moving the drive loading jig so that a surface of the drive loading jig is positioned parallel to a surface of the adapter card;

fastening the drive and the drive loading jig to the adapter card at a location remote from the insertion end of the drive and the opening of the drive loading jig; and removing the drive loading jig from the adapter card and the drive by sliding the drive loading jig away from the adapter card.

2. The method of claim 1, wherein the set insertion angle range is at least 5°.

3. The method of claim 1, wherein the set angle insertion range is 5° to 30°.

* * * * *